United States Patent [19]

Kuo

[11] 3,947,909

[45] Apr. 6, 1976

[54] POWER-DRIVEN KITCHEN UTILITY TOOL

[76] Inventor: Ming-Chuan Kuo, 19350 Christina Court, Cerritos, Calif. 90701

[22] Filed: May 5, 1975

[21] Appl. No.: 574,574

Related U.S. Application Data

[63] Continuation-in-part of Ser. No. 483,215, June 26, 1974, abandoned.

[52] U.S. Cl. ..... 15/23; 51/99

[51] Int. Cl.[2] ..... A46B 13/02

[58] Field of Search ..... 15/22 R, 23, 24, 28, 29, 15/97 R, 93; 32/23–26; 51/68, 69, 99, 126, 47, 168, 170 R; 74/423, 425, 606; 30/180, 228; 248/13, 17

[56] References Cited

UNITED STATES PATENTS

| | | | |
|---|---|---|---|
| 766,182 | 8/1904 | Hale | 15/23 |
| 858,919 | 7/1907 | Stewart | 15/23 X |
| 1,669,560 | 5/1928 | Himes | 32/23 X |
| 1,795,262 | 3/1931 | Myers | 51/99 X |
| 2,956,546 | 10/1960 | Teters et al. | 51/170 R X |

*Primary Examiner*—Edward L. Roberts
*Attorney, Agent, or Firm*—Christie, Parker & Hale

[57] ABSTRACT

A power-driven kitchen utility tool comprises a drive motor mounted on a two-way swivel, and an articulated, hand-positioned drive mechanism for transmitting power from the motor to a rotary-driven kitchen implement such as a sink brush or mixer blades. The articulated drive mechanism includes an elongated rotary drive shaft engaged with the motor output shaft, an elongated rotary-driven output shaft having a working end to which the rotary kitchen implement is attached, and a speed-reducing gear assembly connected between the drive shaft and the output shaft. The gear assembly provides two-way swivel motion of the output shaft relative to the drive shaft during operation of the motor, and permits the output shaft and the kitchen implement to swivel to a completely collapsed rest position adjacent the motor.

19 Claims, 6 Drawing Figures

POWER-DRIVEN KITCHEN UTILITY TOOL

CROSS-REFERENCE TO RELATED APPLICATION

This is a continuation-in-part of my application Ser. No. 483,215, filed June 26, 1974, now abandoned.

BACKGROUND

This invention relates to power-driven implements operated by rotary drive motors, and more particularly to a completely collapsible, hand-positioned, power-operated kitchen utility tool.

At the present time, kitchens are generally well-equipped with modern appliances to improve the quality and efficiency of household work. However, much of the kitchenware washing is still done by hand, even though many people now own dishwashers. Dishwashers are convenient for washing a relatively large amount of dishes in a given load, but many pots and pans can only be cleaned by hand. The cleaning work becomes exceedingly difficult when the pots and pans, and even other kitchenware, are covered by hard-over-burned solids, or sticky thick grease.

In one embodiment, the present invention provides a hand-positioned, power-driven kitchen sink brush which cleans kitchenware much more effectively than common hand-held fixed brushes. The brush is driven by a motor connected to an articulated drive mechanism which includes a speed-reducing gear assembly. The gear assembly provides a two-way swivel for the brush as it rotates, and also allows the drive mechanism to move into a completely collapsed position for putting the brush in a fixed retracted position when not in use.

Thus, the invention allows the user the clean kichenware easily and with good efficiency, because the brush can be readily moved to any desired position when being used, and can be easily placed in its retracted position when not used. As such, the invention represents an improvement over the following patents:

| U.S. Pat. No. | Inventor |
|---|---|
| 766,182 | A. L. Hale |
| 858,919 | J. K. Stewart |
| 1,669,560 | W. H. Himes |
| 1,795,262 | H. L. Myers |

The power-operated devices disclosed in these patents do not provide hand-operated implements which include a speed-reducing gear assembly which provides a two-way swivel during operation of the motor and which is also completely retractable when not in use.

SUMMARY

Briefly, the invention comprises a drive motor having an articulated, hand-positioned, power-driven mechanism which includes an elongated rotary drive shaft, a separate elongated rotary-driven output shaft having a working end engaged with an implement to be driven by the drive motor, and a gear assembly driven by the drive shaft of the motor and engaged with the output shaft for rotating the implement attached to the shaft. The gear assembly is a compact unit which not only reduces the speed of the output shaft relative to the motor drive shaft, but also provides a two-way swivel for the output shaft relative to the motor drive shaft during operation of the motor. The gear assembly permits the output shaft to swivel laterally relative to the axis of the motor drive shaft. It can also swivel toward and away from the motor drive shaft and motor, permitting the output shaft to collapse to a rest position adjacent the motor and its drive shaft.

In a preferred form of the invention, the motor drive shaft has a worm gear reduction for rotating at a slower rate than the motor drive shaft. The worm gear reduction is engaged with a follower gear mechanism which includes a pair of 90° bevel gears for transmitting the speed reduction to the rotary-driven output shaft and the implement attached to it. The worm gear reduction transmits power while permitting the output shaft to swivel laterally relative to the motor drive shaft, and the bevel gear follower transmits power while enabling the output shaft to swivel toward and away from the axis of the motor drive shaft.

Preferably, the motor is mounted on a two-way swivel for allowing the motor to swivel about a substantially horizontal axis so as to raise and lower the end of the motor drive shaft, which, in turn, raises and lowers the working end of the output shaft. The motor also is mounted on a second swivel for swinging the end of the motor drive shaft laterally through an arc about a vertical axis through the motor. Preferably, the swivel mounting of the motor allows the motor to act as a counterweight to statically balance the articulated drive mechanism which consists of the motor drive shaft, gear assembly, and output shaft and the implement attached to the output shaft. This minimizes its inertia and therefore the effective weight of the hand-operated implement during use. It also reduces substantially the amount of room required for the device, which leaves clear most of the working area in the vicinity of the device, and also effectively insures the easy mobility of the implement.

These and other aspects of the invention will be more fully understood by referring to the following detailed description and the accompanying drawings.

DRAWINGS

DETAILED DESCRIPTION

Figure 1:
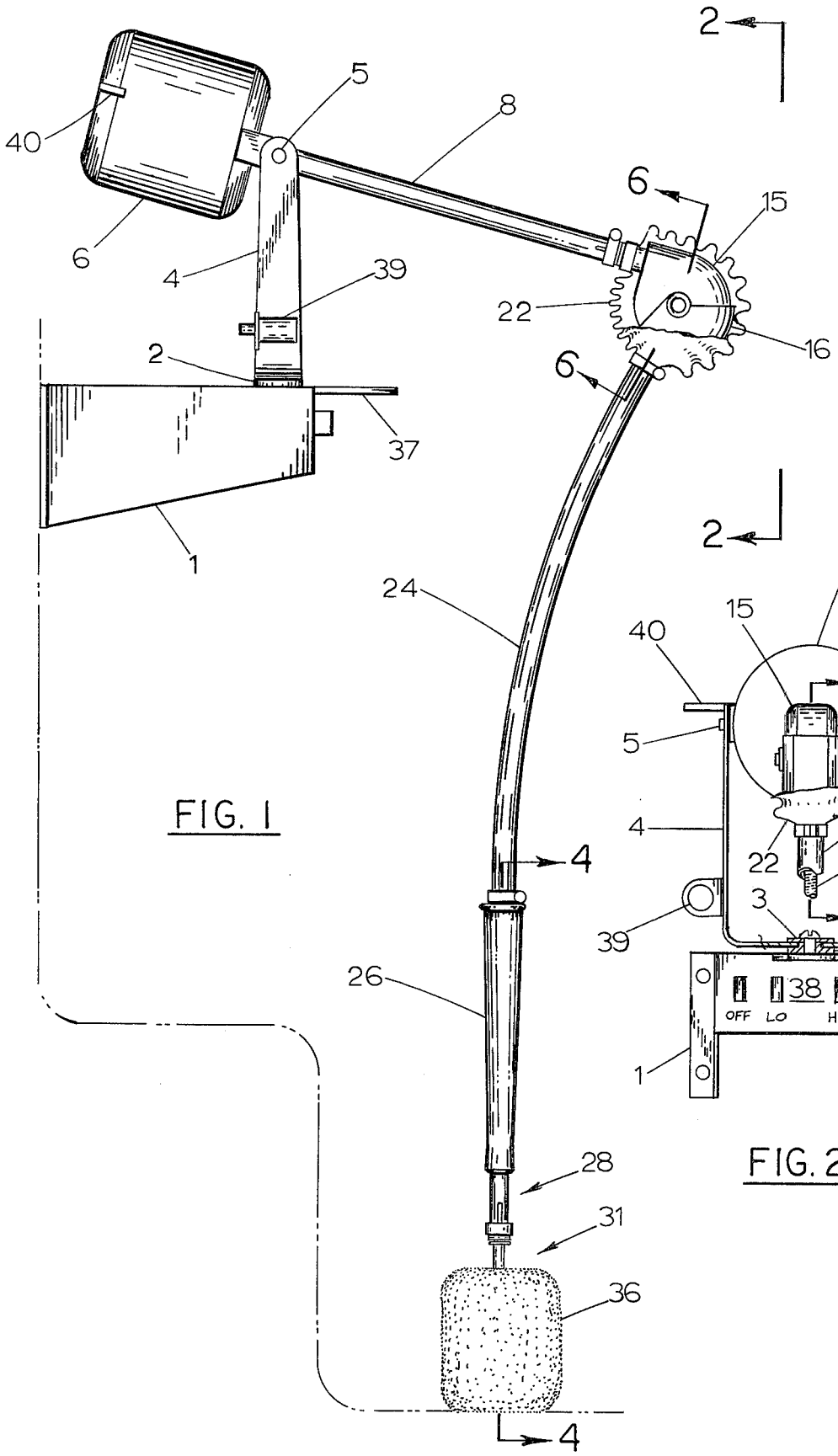
FIG. 1 is a side elevation view, partly broken away, showing a hand-operated power utility tool of this invention in the form of a power-operated brush for kitchen sinks.
Figure 2:
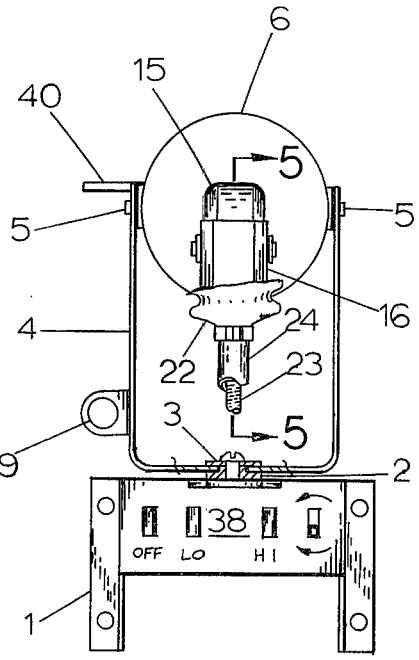
FIG. 2 is a fragmentary front elevation view, partly broken away, taken on line 2—2 of FIG. 1.

Referring to the drawings, the present invention is shown in the context of a hand-positioned, power-driven rotary brush for use in kitchen sinks, or the like. In FIG. 1 the device is shown mounted on a base bracket 1 attached to a kitchen wall adjacent a kitchen sink. A U-shaped yoke bracket 4 is rotatably mounted on the bracket 1 by a shouldered thrust washer 2 located between the bracket and the base of the yoke, and a plain thrust washer 3 resting on top of the yoke bracket base. The yoke bracket is affixed to the bracket by a suitable fastener extending through vertically aligned openings in the washers 2 and 3. Preferably, the washers 2 and 3 are made from a low-friction and corrosion-resistant material such as Teflon.

A pair of horizontally extending and coaxially aligned trunnions 5 extend through a correspondng pair of coaxial holes located in the top portions of the two upright legs of the yoke bracket 4. The trunnions 5 pivotally engage opposite sides of a bracket attached to the front of the housing of a rotary drive motor 6.

Thus, the drive motor 6 is mounted on a two-way swivel. The motor rotates about a horizontal axis through the top portions of the legs of the yoke bracket 4. It also pivots about a vertical axis through the thrust washers 2 and 3 at the base of the yoke bracket 4.

An elongated rotary drive shaft 7 of the motor is enclosed in a tubular housing 8, one end of which is secured to the housing of the motor 6. The working end of the drive shaft 7 drives a gear assembly 14 which includes a worm 10 driven by the drive shaft 7. The worm is engaged with a worm wheel 11. A first bevel gear 12 is coaxially mounted on a rotatable gear shaft 17 along with the worm wheel 11 so that both rotate together on the shaft when driven by the worm 11. A second bevel gear 13 is engaged at a 90° angle with the first bevel gear 12.

The worm gears provide speed reduction and the bevel gear follower provides directional control of the power transmitted by the gear assembly. The gear assembly 14 is partially enclosed in upper and lower gear housings 15 and 16. The end portion of the rotary shaft 7 adjacent its attachment to the worm 10 is rotatably mounted in the internal portion of a flanged double concentric bearing 9 disposed within the end portion of the tubular housing 8.

The upper gear housing 15 is rotatably supported on the external portion of the double concentric bearing 9. The gear housing has a pair of opposite holes aligned coaxially on a horizontal axis in which the gear shaft is rotatably supported. A cylindrical spacer 18 mounted on the gear shaft 17 positions the worm wheel below the worm 10.

The second bevel gear 13 has a downwardly extending stub shaft 20 which is supported by a flanged cylindrical bearing 21 mounted in the lower gear housing 16. The lower gear housing 16 has a pair of horizontally aligned holes on opposite sides which are aligned on the same axis as the pair of holes in the upper gear housing 15. The gear shaft 17 extends through the aligned holes of both the upper and lower gear housings to pivotally support the lower gear housing for rotation about the shaft. The gear shaft 17 is retained in position axially by a pair of snap rings 19 located at the opposite outer ends of the shaft adjacent the outer sides of the lower gear housing.

Hence, the lower gear housing 16 pivots relative to the upper gear housing on the axis of the gear shaft 17.

The two pairs of gears 10, 11, 12, 13, and their gear housings 15 and 16, together with the double concentric bearing 9 and the gear shaft 17, form a collapsible, speed-reducing two-way swivel gear assembly. The upper gear housing 15 can pivot relative to the axis of the motor drive shaft 7, while the hinged lower gear housing 16 can pivot toward and away from the motor drive shaft on the axis of the gear shaft 17. During pivotal motion of the upper gear housing 15, the worm wheel 11 constantly remains meshed with the gear teeth of the worm 10 around 360° of possible rotation about the outer surface of the worm 10. As the lower gear housing 16 pivots about the gear shaft 17 relative to the upper gear housing, the gear teeth of the second bevel gear 13 constantly remain meshed with the gear teeth of the first bevel gear 12 as the second bevel gear 13 rotates from power being transmitted by the first bevel gear 12. Thus, the gear assembly provides speed reduction while allowing two-way swivel motion of the gear assembly parts during operation of the drive motor.

Both upper and lower gear housings 15 and 16 are enclosed in a flexible housing or boot 22.

An elongated, flexible rotary-driven output shaft 23 is connected at its upper end to a stub shaft 20 extending downwardly from the second bevel gear 13. The flexible shaft 23 is enclosed in an elastically flexible tubular housing 24. The lower end of the rotary output shaft 23 is connected to the top of a rotary handle shaft 25. The handle shaft extends through the central axis of an upright tubular handle 26 supported by two cylindrical bearings 27 located at the ends of the handle 26. The top end of the flexible tubular housing 24 is fastened to the lower gear housing 16. Its lower end supports the handle 26.

The bottom of the handle shaft 25 mounts a connector 28 which releasably connects to the stem head 32 of a spindle 31. The spindle is a part of any one of many attachments which can be driven by the articulated hand-positioned power-driven mechanism, and in the drawings the spindle is shown as being part of a rotary power brush having bristles 36 attached to the spindle 31. As an alternative, mixer blades (not shown) for a rotary mixer can be attached to the spindle.

The drawings show one of many possible ways of releasably attaching the spindle to the connector 28. The main body of the releasable spindle connector 28 includes a flanged tubular section 29 surrounding the lower portion of the handle shaft and the upper portion of the rotary spindle. The tubular section 29 has an internal annular groove near its bottom, and four vertically extending and equally spaced apart slotted openings. The spindle connector also has a collar 30 for slidably confining the O.D. of the tubular section 29. Near the stem head 32 the spindle 31 has two diametrically opposite, vertically extending and laterally outwardly projecting keys 33. The spindle is releasably engaged with the connector 28 by sliding the stem head 32 into the tubular section 29 so that the keys 33 fit into the slots in the tubular section. The spindle head slides upwardly until a disk flange 34 on the lower portion of the stem head stops against the bottom open end of the tubular section 29. In this position, a circular ring 35 seats in an internal annular groove in the tubular section 29. A collar 30 which extends around the O.D. of the tubular section is then slid downwardly to elastically deform the diameter of the open end of the tubular section until the collar 30 stops against the outwardly projecting flange at the bottom open end of the tubular section 29. The O.D. of the circular ring 35 is slightly larger than the adjacent I.D. of the tubular section 29, which provides an axial locking action to releasably clamp the spindle in the tubular housing 29.

This releasable mounting of the spindle has proved especially good at keeping the rotary brush steady during use when side forces are applied to the brush.

Preferably, the mounting bracket 1 mounts a motor control panel 38 which includes on-off, and spindle direction switches to match the functions of the drive motor 6.

Figure 3:
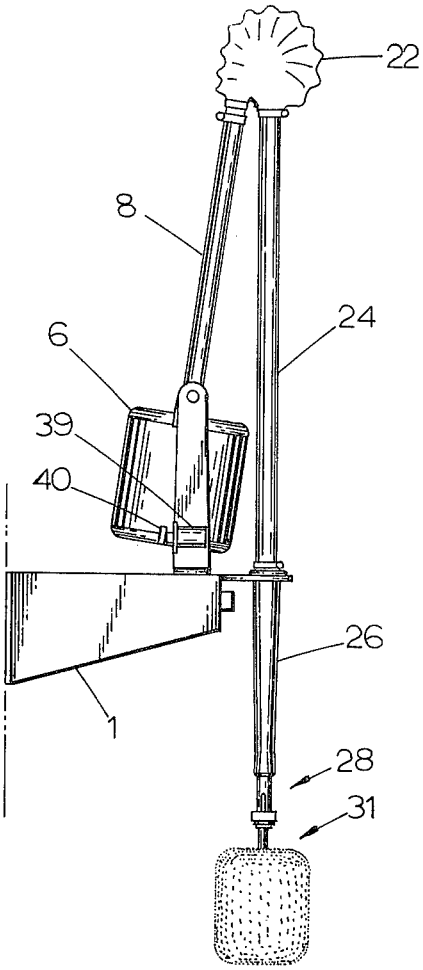
FIG. 3 is a side elevation view showing the apparatus of FIG. 1 in a retracted position.
Figure 4:
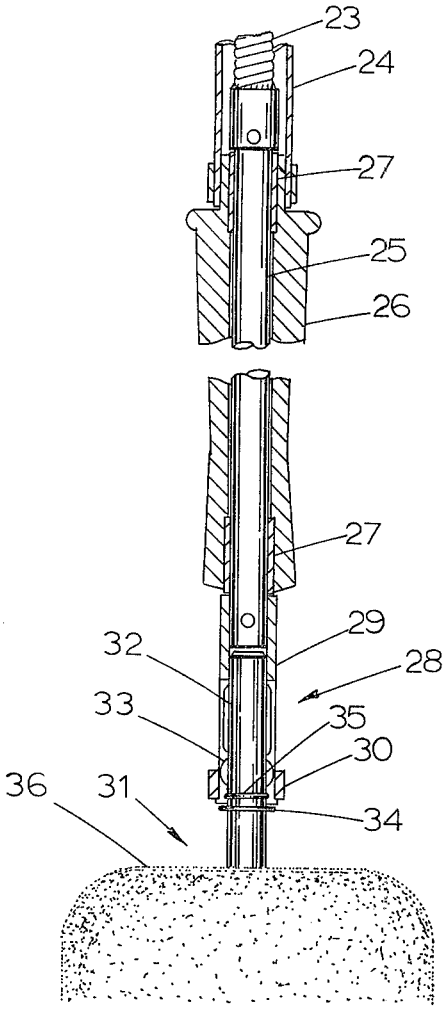
FIG. 4 is a fragmentary cross-sectional view taken on line 4—4 of FIG. 1.
Figure 5:
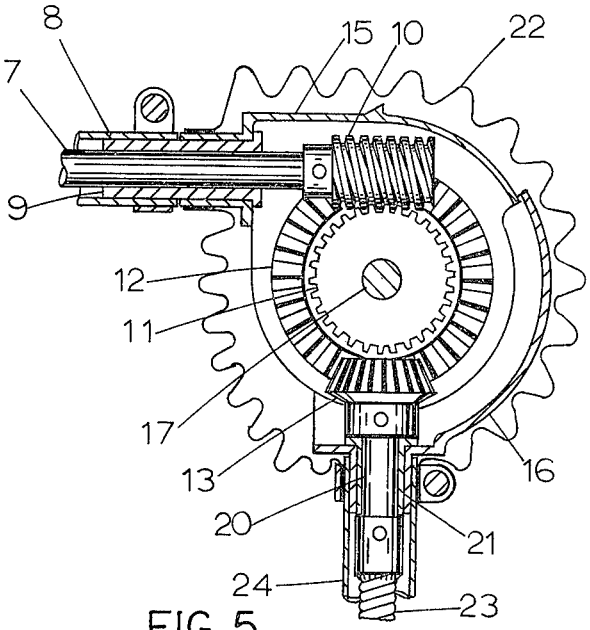
FIG. 5 is a fragmentary cross-sectional elevation view, partly broken away, taken on line 5—5 of FIG. 2.
Figure 6:
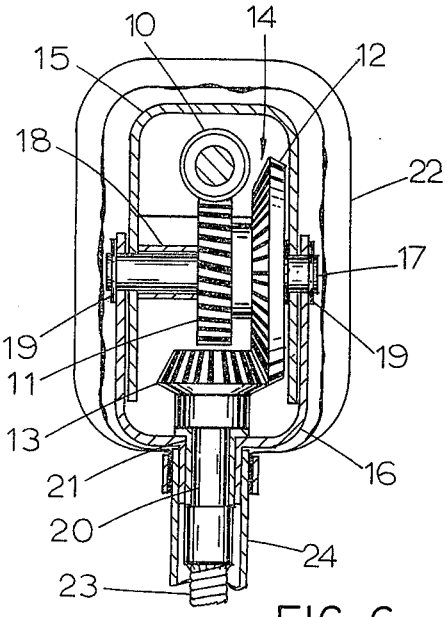
FIG. 6 is a fragmentary cross-sectional elevation view, partly broken away, taken on line 6—6 of FIG. 1.

Immediately above the control panel 38 is a handle hanger 37 which is secured to the base bracket 1. When the brush is moved to its retracted position shown in FIG. 3, a flange at the top of the handle 26 rests on the handle hanger to keep the brush drive mechanism in its retracted position.

A normally-closed control switch 39 is mounted horizontally on the side of the yoke bracket 4. When the handle 26 rests on the handle hanger 37, the normally-closed control switch 39 is depressed by an arm 40 fastened to the housing of the motor 6 to open the switch 39. When the handle is removed and lowered into its operating position, the arm 40 moves away from the switch to close the switch and thereby operate the brush 36. This mounting and motor-starting arrangement eliminates electrical shock hazard because the user need not contact the starting switch.

In using the invention, the spindle 31 of the brush 36 is attached to the spindle connector 28. A flexible electric cord from the motor control panel 38 is connected to an outside power source. The on-off switch on the control panel 38 is set to the "on" position, and the desired speed is selected on the motor control panel. Once the handle 26 is removed from the handle hanger 37 and lowered for use, the normally-closed control switch 39 is released from contact with the arm 40 to turn on the motor 6. The motor drives the worm gear reduction 10 and 11 through the motor extension shaft 7, and the worm gear reduction drives the bevel gear follower 12 and 13 to provide speed reduction for the output shaft to which the brush is attached. The flexible shaft driven by the gear assembly rotates the handle shaft and therefore the spindle 31. When the user moves the handle 26 and brush 36 throughout the sink, the yoke bracket 4 swivels about a vertical axis, and the motor is able to swivel up and down about a horizontal axis. The upper gear housing 15 also is able to pivot around the double concentric bearing 9, and the lower gear housing is able to pivot around the upper gear housing on the axis of the gear shaft 17. The combination of these two-way swivel motions, along with the flexibility of the flexible shaft 23, allows the brush to reach all areas of the sink. In addition, by applying a bending moment to the handle 26, the user is able to position the flexible shaft 23 so the brush can be pointed in any desired direction.

The drive motor 6 is mounted to the yoke bracket 4 so that the weight of the motor is statically balanced by the motor drive shaft, the gear assembly, the flexible shaft, handle section, and the brush. The location of the trunnions 5 is such that when the motor drive shaft 7 is in a horizontal plane, and the flexible shaft 23 and the handle shaft 25 are in a vertical orientation, the weight of the motor on the trunnions is statically balanced. This minimizes its moment of inertia about the axis of the trunnions 5, or the thrust washers 2 and 3, and therefore reduces to a minimum the effort required to maneuver the brush.

After work is completed, the handle 26 is returned to rest on the handle hanger 37. The gear assembly allows the brush and the flexible shaft to be completely retracted to the position shown in FIG. 3. That is, the engagement of the second bevel gear to the first bevel gear allows the shaft to swivel to a retracted position at a very small angle relative to the motor drive shaft. In this position the device is completely clear of the kitchen sink area when not in use. When the handle is returned to the handle hanger 37, the arm 40 depresses the normally-closed control switch 39 to turn off the motor 6.

The drive motor 6 preferably is a squirrel-cage type induction motor. This motor is preferably a relatively high speed motor, and requires speed reduction for operating the type of kitchen implements envisioned by this invention. The presently preferred motor is a 3000 rpm induction motor, although other high speed motors also can be used. Such a motor is an advantage because of its much better speed stability when pressure is applied to the brush, and its substantially lower operating noise level when compared with AC-DC motors. The presently preferred arrangement also includes gear reduction for operating the brush at about 400 rpm.

Preferably, the flexible housing 24 for the output shaft 23 is stiffer near the handle 26 than at its opposite end near the gear assembly. Possible means for varying the stiffness of the housing are to embed a coil spring of variable stiffness in the housing, or to add a stiff sleeve to the bottom of the housing. The stiffness variation in the housing allows the flexible output shaft 23 to bend generally uniformly throughout its length to prevent the shaft from being kinked or irreversibly deformed. This extends the life of the flexible shaft. Means also can be provided to releasably attach the flexible output shaft 23 to the gear assembly for easy replacement if need be.

I claim:

1. A hand-positioned, collapsible power-driven kitchen utility tool comprising a drive motor having an elongated rotary drive shaft; an elongated rotary-driven output shaft which is movable relative to the motor drive shaft; a gear assembly driven by the motor drive shaft and engaged with the driven output shaft for rotating the output shaft, the output shaft having a working end for attachment to an implement to be rotated in response to operation of the drive motor; the gear assembly comprising speed reduction means for reducing the speed of rotation of the driven output shaft relative to the motor drive shaft and for providing two-way swivel motion of the output shaft relative to the motor drive shaft during operation of the drive motor, the speed reduction means permitting the output shaft to swivel laterally relative to the axis of the motor drive shaft, and also to swivel toward and away from the motor drive shaft.

2. Apparatus according to claim 1 in which the speed-reducing means comprises a drive gear engaged with the motor drive shaft, a driven gear engaged with the output shaft, a speed-reducing gear engaged with the drive gear for rotating at a slower rate of speed than the drive gear, and a follower gear engaged with the driven gear and rotatable in response to the rotation of the speed-reducing gear, the connection between the follower gear and the driven gear allowing the output shaft to move toward and away from the motor drive shaft, the connection between the speed-reducing gear and the drive gear allowing the output shaft to swivel laterally relative to the axis of the motor drive shaft.

3. Apparatus according to claim 2 in which the drive gear comprises a worm, the speed-reducing gear comprises a worm wheel engaged with the worm, the follower gear comprises a first bevel gear for rotating with the worm wheel in a plane generally parallel to the worm wheel, and the driven gear comprises a second bevel gear engaged with the first bevel gear and rotatable in a plane which intersects the plane of rotation of the first bevel gear.

4. Apparatus according to claim 3 in which the second bevel gear is in substantially the same plane as the worm, allowing the output shaft to be collapsed toward the motor drive shaft so the output shaft and motor drive shaft are in substantially the same plane.

5. Apparatus according to claim 3 in which the drive motor is mounted on a swivel for allowing the motor to rotate about a substantially horizontal axis located remote from the connection of the motor drive shaft to the gear assembly, and further including a brush releasably attached to the working end of the output shaft, the swivel mounting of the motor providing a static balance between the drive motor and the motor drive shaft, gear assembly, output shaft, and the brush.

6. Apparatus according to claim 5 in which the output shaft is flexible.

7. Apparatus according to claim 6 including a second swivel for allowing the motor to swivel about a substantially vertical axis so the motor drive shaft can pivot laterally relative to the vertical axis to change the lateral orientation of the gear assembly, output shaft, and the brush.

8. Apparatus according to claim 2 including a first gear housing pivotally mounted on the end of the motor drive shaft and rotatable about the axis of the drive shaft relative to the drive shaft and the drive gear engaged therewith, and a second gear housing pivotally mounted to the first gear housing to pivot relative thereto, the output shaft being attached to the second gear housing with the driven gear of the output shaft rotating relative to the second gear housing.

9. Apparatus according to claim 8 in which the second gear housing is pivoted to the first gear housing on a gear shaft to which the speed-reducing gear and follower gear are attached, the second gear housing being mounted to pivot relative to the first gear housing, speed-reducing gear and follower gear.

10. Apparatus according to claim 9 in which the drive gear comprises a worm, the speed-reducing gear comprises a worm wheel engaged with the worm, the follower gear comprises a first bevel gear for rotating with the worm wheel in a plane generally parallel to the worm wheel, and the driven gear comprises a second bevel gear engaged with the first bevel gear and rotatable in a plane which intersects the plane of rotation of the first bevel gear.

11. Apparatus according to claim 1 including a first swivel for rotating the motor drive shaft about a substantially horizontal axis to adjust the vertical orientation of the gear assembly and the output shaft.

12. Apparatus according to claim 11 including a second swivel means for pivoting the motor drive shaft about a vertical axis for allowing the motor drive shaft to change the lateral orientation of the gear assembly and the output shaft.

13. Apparatus according to claim 1 including means for swivel-mounting the drive motor so it rotates about a substantially horizontal axis remote from the connection of the motor drive shaft to the gear assembly, the swivel mounting of the motor providing a static balance between the motor and the drive shaft, gear assembly, and output shaft.

14. Apparatus according to claim 1 in which the drive motor comprises an induction motor.

15. Apparatus according to claim 1 in which the output shaft comprises an elongated flexible shaft.

16. Apparatus according to claim 1 including a tool releasably attached to the working end of the output shaft.

17. Apparatus according to claim 16 in which the tool comprises a rotary brush.

18. Apparatus according to claim 1 including means on the lower end of the output shaft for releasably attaching a spindle of a tool to be rotated to the output shaft, the releasable attaching means including:

a. a deformable sleeve surrounding the lower portion of the rotatable output shaft, the sleeve having a flange at its bottom, an internal annular groove near its bottom, and a plurality of circumferentially spaced apart slotted openings extending lengthwise through the wall of the sleeve above the flange and the internal groove;

b. a plurality of circumferentially spaced apart keys extending lengthwise along the spindle for fitting into the slotted openings of the sleeve and projecting outwardly from the slotted openings when the spindle is inserted in the sleeve, a stop on the spindle for engaging the bottom of the sleeve, and a ring on the spindle for being releasably seated in the groove in the sleeve when the stop engages the bottom flange of the sleeve; and c. a slidable collar around the exterior of the sleeve for sliding over the exterior of the sleeve and engageable with the top of the flange to squeeze the bottom of the sleeve to hold the ring in the groove of the sleeve and thereby releasably hold the spindle in the sleeve.

19. Apparatus according to claim 1 including a normally-closed switch for operating the motor, the switch being mounted adjacent the motor, a hanger adjacent the switch for releasably holding the working end of the output shaft, and means carried by the output shaft for contacting the switch when the output shaft is held by the hanger to stop the motor, the motor being operated when the switch contacting means is removed from contact with the switch.

* * * * *